United States Patent [19]

Krauska

[11] Patent Number: 4,852,939

[45] Date of Patent: Aug. 1, 1989

[54] DEVICE FOR CONVERTING A RECLINER CHAIR TO A RECLINER-LIFT CHAIR

[75] Inventor: Bernard J. Krauska, Wauwatosa, Wis.

[73] Assignee: Orthokinetics, Inc., Waukesha, Wis.

[21] Appl. No.: 243,151

[22] Filed: Sep. 9, 1988

Related U.S. Application Data

[63] Continuation of Ser. No. 113,374, Oct. 23, 1987, abandoned, which is a continuation of Ser. No. 932,171, Nov. 18, 1986, abandoned.

[51] Int. Cl.[4] ..... A47C 1/02

[52] U.S. Cl. ..... 297/71; 297/85; 297/330; 297/DIG. 10

[58] Field of Search ..... 297/85, DIG. 10, 330, 297/71

[56] References Cited

U.S. PATENT DOCUMENTS

| | | | |
|---|---|---|---|
| 3,572,823 | 3/1971 | Hampton | 297/85 |
| 3,743,349 | 7/1973 | Crum et al. | 297/85 |
| 4,007,960 | 2/1977 | Gaffney | 297/DIG. 10 |
| 4,083,599 | 4/1978 | Gaffney | 297/330 |
| 4,365,836 | 12/1982 | Jackson et al. | 297/85 |
| 4,453,766 | 6/1984 | Di Vito | 297/DIG. 10 |
| 4,570,996 | 2/1986 | Rogers | 297/85 |

FOREIGN PATENT DOCUMENTS

| | | | |
|---|---|---|---|
| 0077280 | 4/1983 | European Pat. Off. | 297/DIG. 10 |

*Primary Examiner*—Francis K. Zugel

*Attorney, Agent, or Firm*—Fuller, Puerner & Hohenfeldt

[57] ABSTRACT

Disclosed herein is a lift base for converting a manual reclining chair to a powdered lift and reclining chair. The base is readily attached to the reclining hinge and drives the hinge parts as well as the chair frame. A simplified base linkage uses linkage plates as a common pivot mount for link connections inbetween the base and the chair.

15 Claims, 5 Drawing Sheets

DEVICE FOR CONVERTING A RECLINER CHAIR TO A RECLINER-LIFT CHAIR

This is a continuation of co-pending Serial No. 113,374 filed on Oct. 23, 1987, which is a continuation of Serial No. 932,171, filed Nov. 18, 1986.

FIELD OF THE INVENTION

The invention relates to reclining lift chairs which are power actuated.

BACKGROUND OF THE INVENTION

Various recliner lift chairs are available which have been developed principally for the elderly and handicapped to assist them in moving into a standing position from a seated position. Further developments include adapting the elevator lift chairs to have a reclining mode with a foot rest which supports the legs in a reclined position. Various manual reclining chairs have been available as conventional furniture for some time. Heretofore power actuated bases and linkage systems have not been available to readily convert a conventional recliner chair into a powered recliner lift chair.

SUMMARY OF THE INVENTION

The invention provides a base and linkage system which is adapted to be readily attached to an existing manual recliner chair to convert the chair into a powered recliner lift chair. The base of the invention includes a simplified linkage which employs spaced linkage control plates which act as intermediate pivot points between the base and the driving linkage which lifts and tilts the chair. The control plates are readily attached by brackets mounted thereon to the lower hinge mounting rails of standard recliner hinge assemblies on reclining chairs. The existing fasteners which secure the reclining hinges to the chair are merely backed off a short distance and the slots in the control plates are readily positioned between the hinge and the chair frame. The driving linkage of the base is readily attached to the upper hinge linkage mounting rail. The power actuator drives the reclining linkage through the various ranges in the lift mode and reclining mode rather than driving portions of the seat or chair frame as in prior art power actuated recliner lift chairs. This reduces creaking which can occur as in the prior art recliner lift chairs when the lifting reclining forces are transmitted to certain spaced locations on the wooden frame rather than to the hinge.

The linkage control plates are rather large in area and are provided with surface that sweeps adjacent the longest link arms which connect the plates to the base to provide lateral stability to the link arms to minimize twisting or bending of the links.

A chair frame design is also provided in which the corners of the chair frame about the base frame are provided with recesses filled with foam to eliminate pinch points. The foam also provides a backing for the chair covering fabric over the recesses.

Further objects, features and advantages of the invention will become apparent from the disclosure.

DESCRIPTION OF THE DRAWINGS

FIG. 7 is a side elevational view of the chair in the lift mode.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structure. The scope of the invention is defined in the claims appended hereto.

Figures 1, 2:
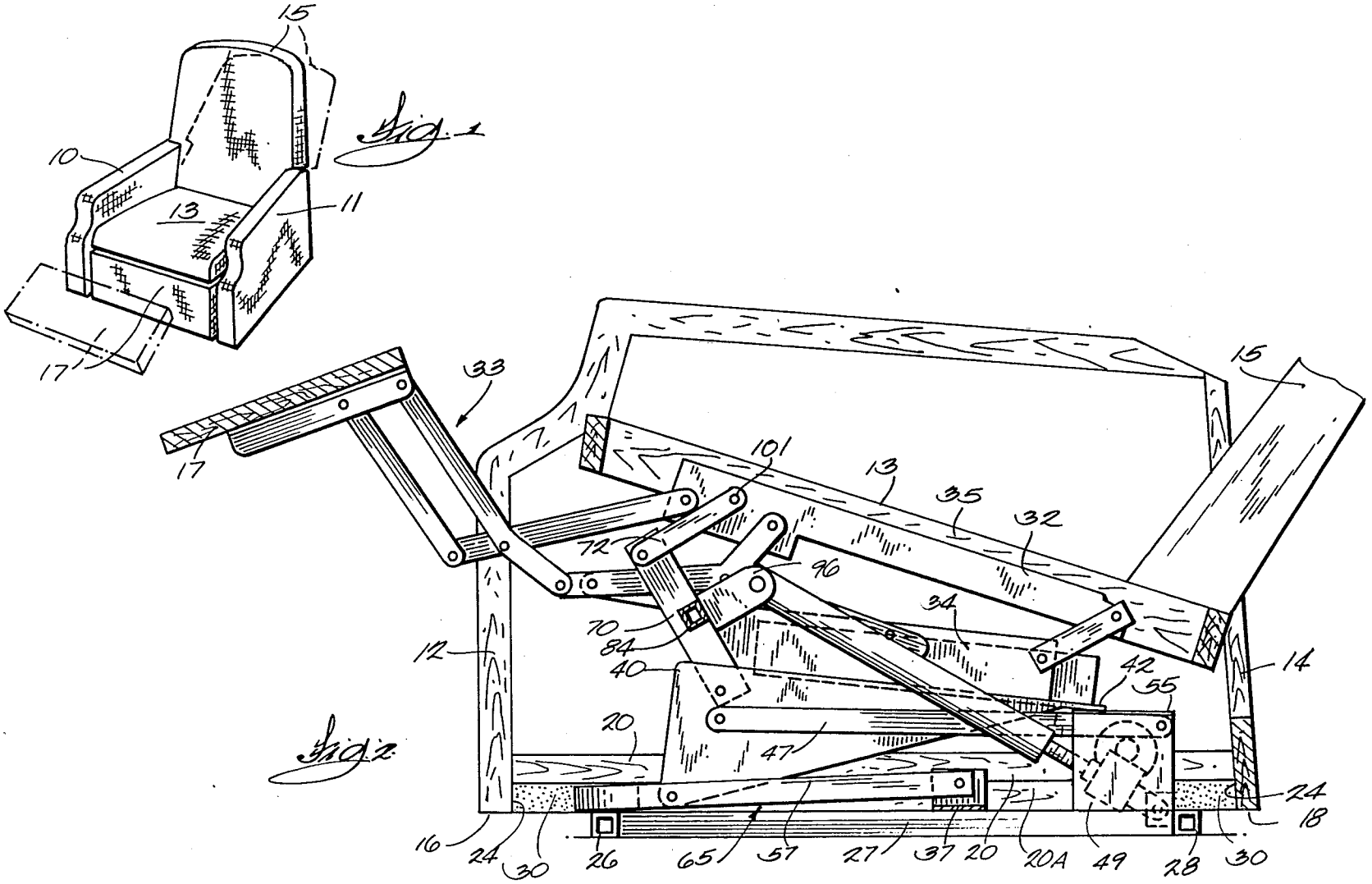
FIG. 1 is a diagrammatic perspective of the chair parts of a recliner lift chair.
FIG. 2 is a fragmentary side elevational view fragmentary section of a recliner lift chair in accordance with the invention in the recliner mode.

FIG. 1 shows a typical reclining chair with a seat 13, back 15 and foot rest 17.

Figure 3:
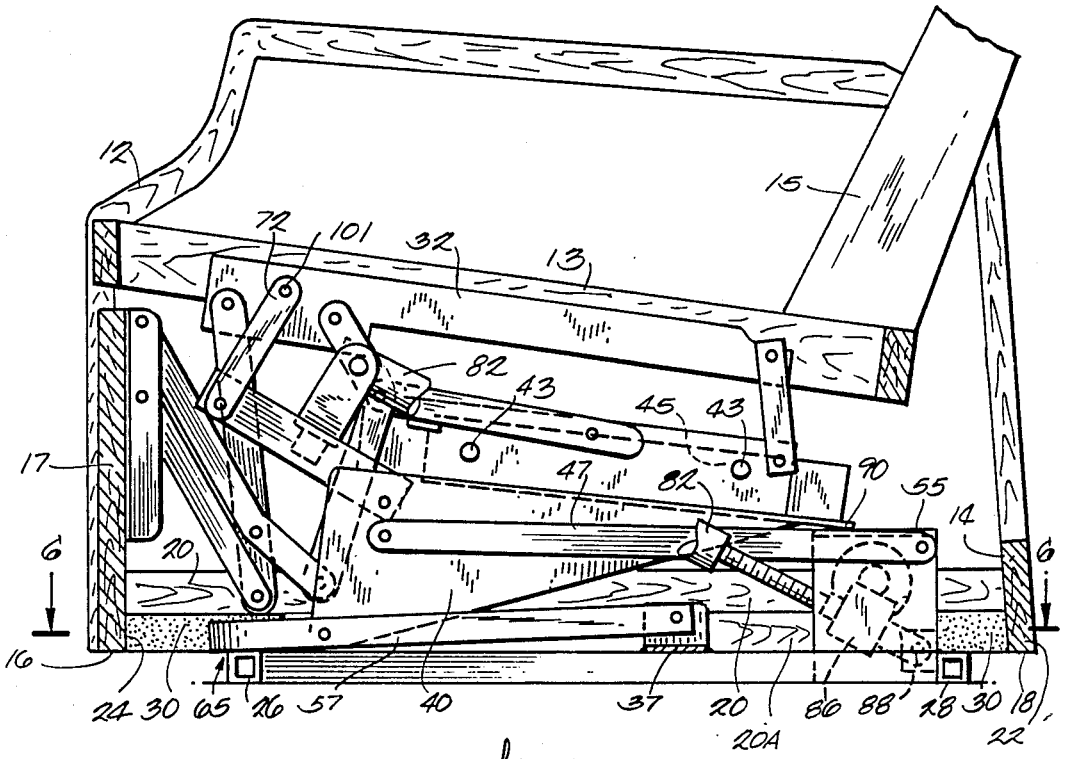
FIG. 3 is a side elevational view of the chair embodying the base of the invention with the chair in a partial reclining position.
Figure 5:
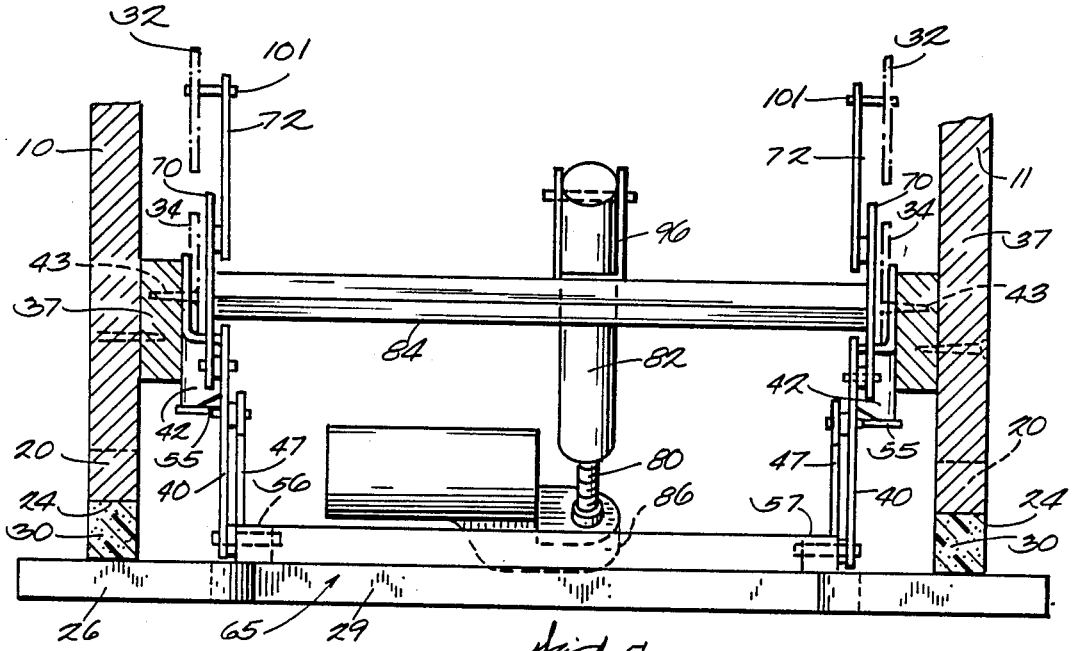
FIG. 5 is a front view of the base.
Figure 6:
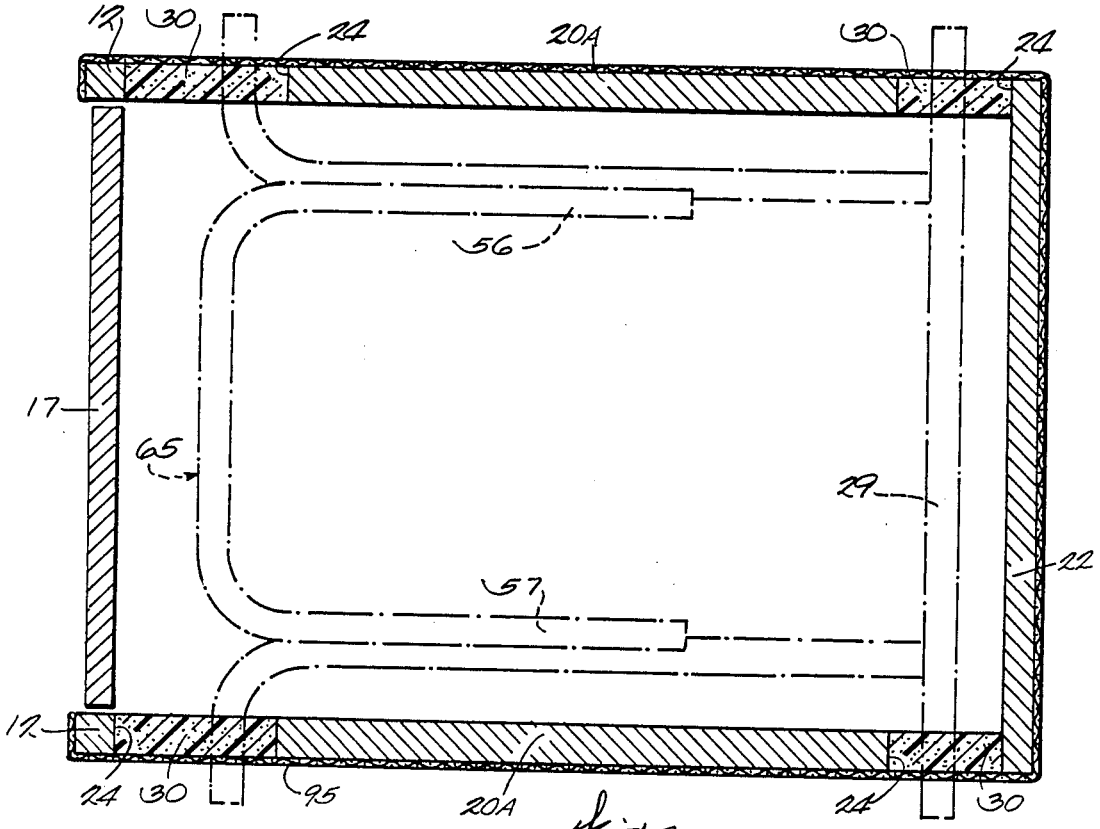
FIG. 6 is a view of the base along line 6—6 of FIG. 3.
Figure 2:
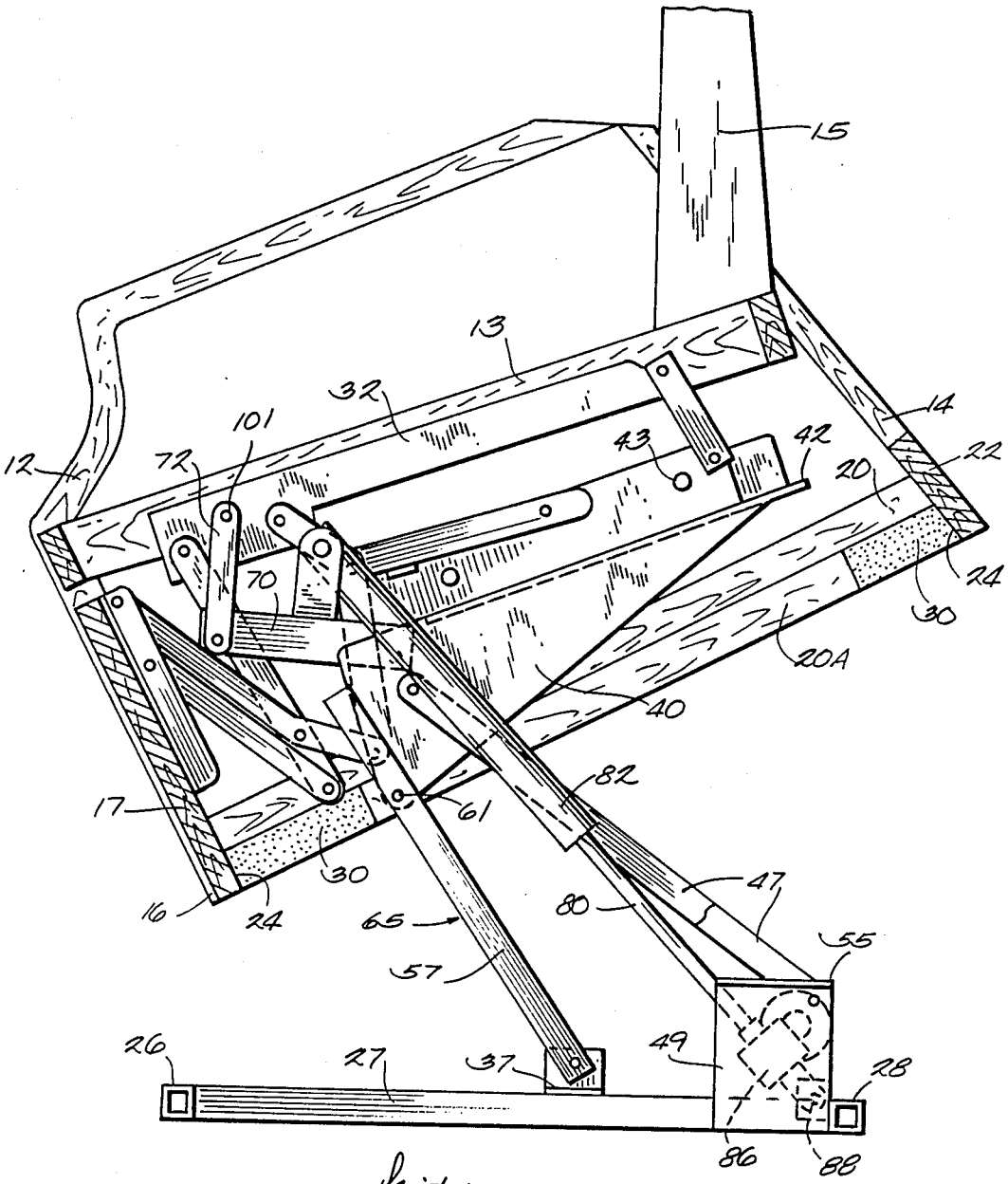

FIGS. 1, 2 and 5 show side frames 10 and 11 of the reclining chair which have front vertical frame members 12 and rear vertical member 14 (FIG. 7) with lower ends 16 and 18 (FIG. 3). The front and rear vertical members 12 and 14 are interconnected by a generally horizontal extending tie frame members 20 and 20A (FIG. 7) which are fastened together to form a unit and provide for pockets 24 above the frame ends 16 and 18 which pockets are occupied by foam 30. A cross-frame member 22 interconnects the two side frames. The member 22, together with the front and rear frame members and member 20, provides said pockets 24 which are positioned over the horizontal base frame members 26 and 28 (FIGS. 6, 7). The pockets are filled with foam pads 30 as shown in FIG. 2 which are flush with the exterior of the frame members and flush with the bottom of the ends 16 and 18 and the frame 20. Hence the foam pads provide a back up for upholstery 95 (FIG. 6) and eliminates finger pinch points between the base frame and the base.

A conventional reclining chair which is not powered is typically provided with a hinge linkage 33 (FIG. 2) for purposes of controlling the reclining movement and position of the foot rest and seat and back assembly. The reclining hinge linkage 33 illustrated, is a Leggett & Platt 8500 two-way hinge which accommodates a seat and back rest 13 and 15 which are rigidly secured in fixed relationship. Alternatively a three-way hinge such as a Leggett & Platt Model No. 8254 could be employed wherein the back rest 15 is movable with respect to the seat 13.

Figure 1A:
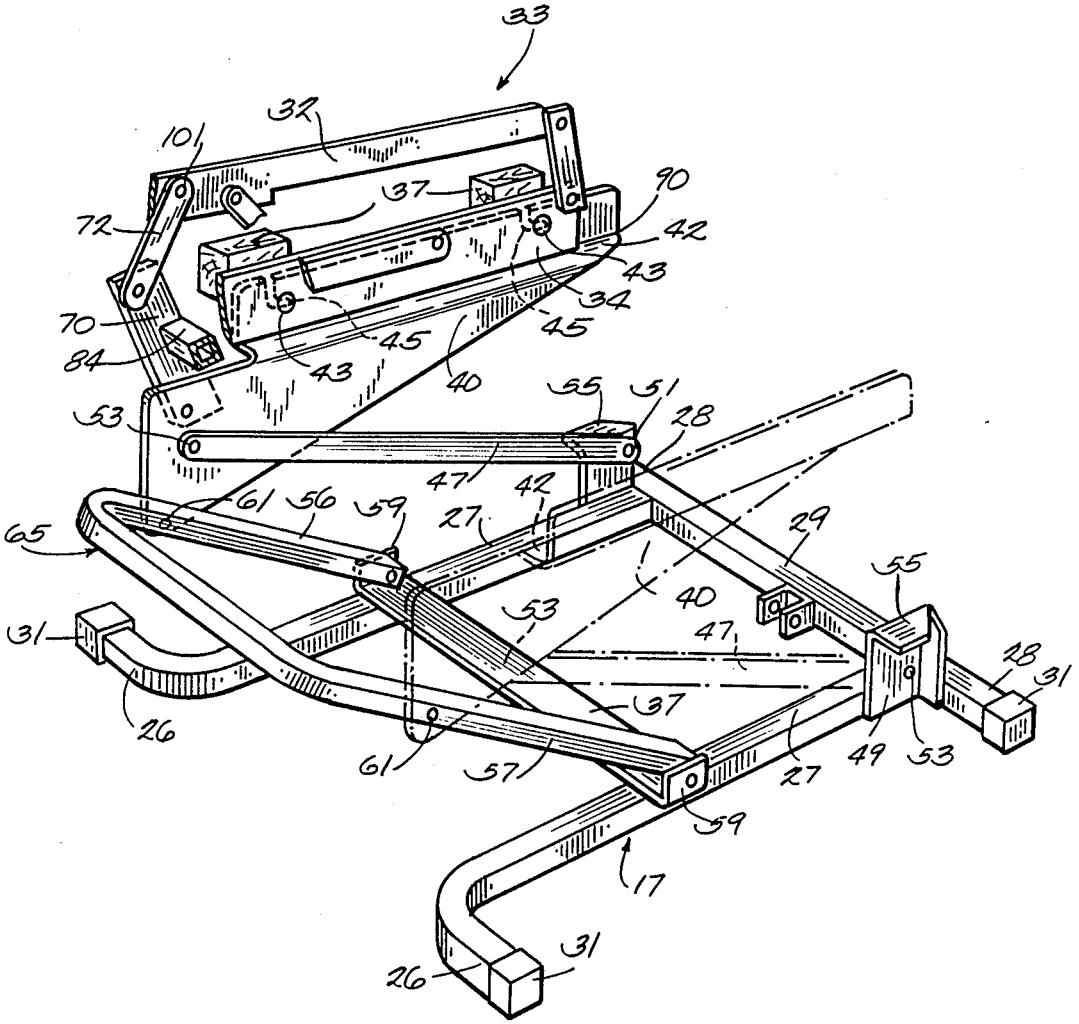
FIG. 1A is a fragmentary perspective view of the base of the invention.

The standard hinge 33 is provided with an upper mounting rail 32 and lower mounting rail 34 (FIGS. 1A, 2, 5). The mounting rails 32 are fixed to the side frame 35 of the seat 13 and the side rails 34 are normally fixed to the mounting blocks 37 on the chair side frame 10 and 11. Thus the seat and back rest are typically suspended between the side frames which remain in floor engagement through the connections of the hinge linkages to the chair side panels 10 and 11.

The base of the invention (FIG. 1A) includes the ground engaging frame 7. The frame includes two parallel frame members 27 interconnected at the rear by frame member 29 which has two leg portions 28 provided with feet 31. The frame portions 27 have outturned leg portions 26 at the front also provided with rubber feet 31. The frame portions are interconnected by a thin web portion 36 which provides flexibility in the base. The base is provided with a pair of spaced linkage control plates 40 which have an offset channel portion 42 which receives the lower mounting rail 34 of the reclining hinge. As illustrated in FIG. 5, assembly of the control plate to the existing reclining chair is accomplished by loosening the fasteners 43 which secure the hinge to the mounting blocks, sliding the slots 45 in the channel members over the fasteners and retightening the fasteners 43. The other connections of the base linkage to the chair will be subsequently described.

The linkage control plates 40 are connected to the base by a pair of elongated links 47 which are connected to upstanding tabs 49 on the base which are provided with outturned flanges 55 which provide support platforms for the lower rear edge of control plates when the chair is in the normal seat position in FIG. 5. Pivot 51 connects the arms or links 47 to the base and pivots 53 connect the links to the control plates 40.

The other connection between the base and the linkage control plates comprises a u-shaped frame 65 which has legs 56 and 57 (FIG. 6) which are connected to upstanding tabs 59 on web 36. Pivots 61 connect the legs 56 and 57 to the linkage control plates 40. The connection of the base to the upper hinge mounting rail 32 is provided by a pair of spaced driven links 70 connected to flying links 72. The connections of links 72 to the rails 32 is best shown in FIGS. 1A, 5 and 7 and is easily accomplished by removing the fastener 101.

Figure 4:
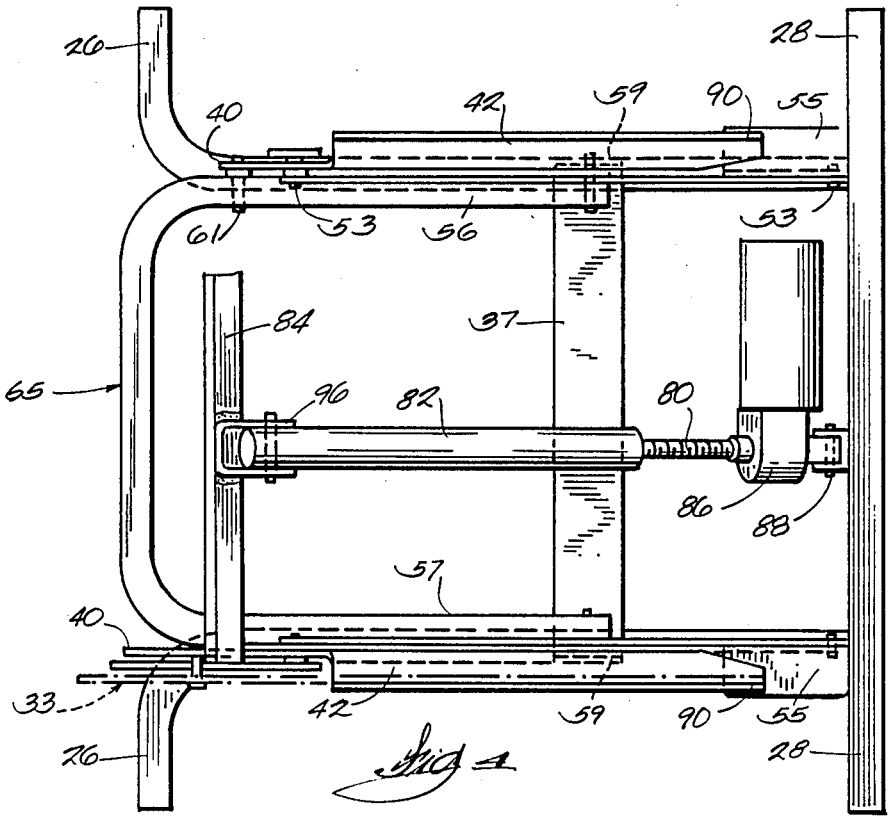
FIG. 4 is a plan view of the base with a chair in the normal sitting position.

Integral with the base is a conventional power actuator (FIG. 4) which includes a screw 80 which cooperates with a screw housing 82 that is pivotally connected to a clevis-like bracket 96 to power the driven links 70 which are connected by a cross-member 84 to which bracket 96 is joined. The screw is driven by a motor and a gear drive unit 86 which is swingably connected to the base by a pin 88.

The close proximity of elongated arms 47 to the linkage control plates 40 provides control over the arms so that shifting the chair will not bend or twist the arms 47.

In use the rear corner 90 of the linkage control plates rests on the outturned flange 55 of the flanges when the chair is in the normal sitting position illustrated in FIG. 3. Additionally the linkage is supported on the base frame in the collapsed FIG. 3 position with the arms 56 and 57 resting on the arms 27. By operating the power actuator from the at rest point of FIG. 3 to a second point as shown in FIG. 2, the seat 13 reclines relative to the chair frame. By operating the power actuator to a third point as shown in FIG. 7, the entire chair lifts. The base provided for the chair provides a readily attachable base with a linkage which uses the existing connections of the reclining hinge linkage to the chair for assembly of the base to the chair. This greatly facilitates assembly of the base to the chair. It can be readily done in the field without any special tools.

I claim:

1. A lift base useful for converting a manual recliner chair into a combined recliner-lift chair comprising:

a. a generally planar frame for resting on the ground;

b. a generally u-shaped frame having legs with respective free ends, each leg free end being pivotally attached to the planar frame;

c. a pair of spaced parallel linkage control plates having respective first end pivotally joined to a respective leg of the u-shaped frame and respective second ends;

d. a pair of elongated links having respective first ends pivotally attached to a respective linkage control plate and respective second ends attached to the planar frame;

e. driven link means for pivotally connecting to the linkage control plates; and f. power actuator means having a first end pivotally connected to the planar frame and a second end pivotally connected to the driven link means for operating the lift base between a first configuration wherein the u-shaped frame and the linkage control plates rest on the planar frame and a second configuration wherein the u-shaped frame and the linkage control plates are lifted off the planar frame.

2. The lift base of claim 1 wherein:

a. the planar frame is formed with a pair of tabs upstanding therefrom; and b. the linkage control plates second ends rest on respective planar frame tabs when the power actuator means operates the lift base to the first configuration thereof.

3. The lift base of claim 1 wherein the power actuator means is selectively operable when the lift base is in the first configuration thereof to pivot the driven link means on the linkage control plates between a first position wherein the driven link means makes a first predetermined angle with the linkage control plates and a second position wherein the driven link means makes a second predetermined angle with respect to the linkage control plates.

4. The lift base of claim 3 wherein the power actuator means operates to pivot the driven link means to the first position thereof when the power actuator means operates the lift base to the second configuration thereof.

5. The lift base of claim 1 wherein the power actuator means is selectively operated to a first point to operate the lift base to the first configuration and to pivot the driven link means on the linkage control plates to make a first predetermined angle with the linkage control plates, and to a second point to operate the lift base to the first configuration and to pivot the driven link means to make a second predetermined angle with the linkage control plates, and to a third point to operate the lift base to the second configuration thereof and to pivot the driven link means to make the first predetermined angle with the linkage control plates.

6. In combination with a manual recliner chair having a frame; a pair of spaced lower mounting rails attached to the frame; a seat; and linkage means for connecting the seat to the lower mounting rails to enable to the seat to recline relative to the frame;

a base for reclining the chair seat and for lifting the chair frame above a lowered position comprising:

a. a generally planar frame for resting on the ground;

b. a generally u-shaped frame having legs with respective free ends, each leg free end being pivotally attached to the planar frame;

c. a pair of spaced parallel linkage control plates having respective first ends pivotally joined to a respective end of the u-shaped frame and respective second ends, the linkage control plates being in supporting contact with respective lower mounting rails of the chair;

d. a pair of elongated links having respective first ends pivotally attached to a respective linkage control plate and respective second ends attached to the planar frame;

e. driven link means for pivotally connecting the linkage control plates to the respective lower mounting rails; and f. power actuator means pivotally connected between the planar frame and the driven link means for operating the chair to a first configuration wherein the chair frame is in lowered position and the chair seat is in an unreclined position relative to the frame, and to a second configuration wherein the chair frame is in the lowered position and the seat is in a reclined position relative to the frame, and to a third configuration wherein the chair frame is in a lifted position and the seat is in the unreclined position relative to the frame.

7. The combination of claim 6 wherein the driven link means comprises:

a. a pair of driven links having respective first ends pivotally connected to the respective linkage control plates, and respective second ends;

b. a pair of flying links having respective first ends pivotally attached to the respective second ends of the driven links, and respective second ends pivotally attached to the chair seat; and c. cross member means for rigidly connecting the two driven links to each other, the cross member means being pivotally connected to the power actuator means.

8. The combination of claim 6 wherein:

a. the planar frame is formed with a pair of tabs upstanding therefrom; and b. the second ends of the linkage control plates rest on respective planar frame tabs when the power actuator means operates the chair to the first and second configurations thereof.

9. The combination of claim 7 wherein the power actuator means is selectively operable to a first point whereat the cross member means, driven means, and flying links operate with the elongated links and u-shaped frame to rest the linkage control plate on the planar frame and whereat the driven links and flying links cooperate with the linkage control planes to pivot the seat to the unreclined position thereof to thereby place the chair in the first configuration thereof, and to a second point whereat the driven links and the flying links cooperate with the elongated links and the u-shaped frame to rest the linkage control planes on the planar frame and whereat the driven links and flying links cooperate with the linkage control planes to pivot the seat to the reclined position thereof to thereby place the chair in the second configuration.

10. The combination of claim 9 wherein the power actuator means is selectively operable to a third point whereat the cross member means, driven links, and flying links cooperate with the elongated links and u-shaped frame to lift the linkage control planes off the planar frame and whereat the driven links and flying links cooperate with the linkage control plates to pivot the seat to the unreclined position thereof to thereby place the chair in the third configuration thereof.

11. The combination of claim 6 wherein the power actuator means is selectively operable to pivot the driven link means on the linkage control plates between a first predetermined angle with respect to the lower mounting rails and linkage control plates to thereby place the chair seat in the unreclined position and a second predetermined angle with respect to the lower mounting rails and linkage control plates to thereby place the chair in the reclined position.

12. A chair having a frame and a seat that is reclinable relative to the frame, the frame and seat being liftable off the ground comprising:

a. a generally planar frame for resting on the ground;

b. a generally u-shaped frame having legs with respective free ends, each leg free end being pivotally attached to the planar frame;

c. linkage control plate means for pivotally connecting to the u-shaped frame;

d. a pair of elongated links having respective first ends pivotally attached to the linkage control plate means, and respective second ends attached to the planar frame;

e. driven link means for pivotally supporting the chair seat on the linkage control plate means; and f. power actuator means having a first end pivotally connected to the planar frame and the second end pivotally connected to the driven link means for operating the chair between a first configuration wherein the chair seat is in an unreclined position relative to the frame and the frame and seat are in a lowered position relative to the ground, and a second configuration wherein the seat is in a reclined position relative to the frame and the frame and seat are in the lowered position, and a third configuration wherein the seat is in an unreclined position relative to the frame and the seat and frame are in a lifted position relative to the ground.

13. The chair of claim 12 wherein the linkage control plate means comprises:

a. a pair of spaced linkage control plates pivotally attached to the u-shaped frame and to the first ends of the respective elongated links; and b. a pair of spaced lower mounting rails fixed to the respective linkage control plates, the driven link means for pivotally supporting the chair seat being pivotally connected between the linkage control plates and the chair seat.

14. The chair of claim 13 wherein:

a. the planar frame is formed with a pair of tabs upstanding therefrom; and b. the second ends of the linkage control plates rest on respective planar frame tabs when the power actuator means operates the chair to the first and second configurations thereof.

15. The chair of claim 12 wherein the driven link means comprises:

a. a pair of driven links having respective first ends pivotally connected to the linkage control plate means, and respective second ends; and b. a pair of flying links having respective first ends pivotally attached to the respective second ends of the driven links and respective second ends pivotally attached to the chair seat.

* * * * *